United States Patent [19]

Boehmer

[11] 4,083,197

[45] Apr. 11, 1978

[54] AIR CONDITIONER CONTROL SYSTEM

[75] Inventor: Andrew Peter Boehmer, Barrington, Ill.

[73] Assignee: Borg-Warner Corporation, Chicago, Ill.

[21] Appl. No.: 732,270

[22] Filed: Oct. 14, 1976

[51] Int. Cl.[2] ..... F25B 41/00

[52] U.S. Cl. ..... 62/211; 62/229

[58] Field of Search ..... 62/196 C, 209, 211, 62/229

[56] References Cited

U.S. PATENT DOCUMENTS

| | | | |
|---|---|---|---|
| 2,320,055 | 5/1943 | Stickel | 62/211 |
| 3,703,086 | 11/1972 | Nijo | 62/209 |
| 3,759,057 | 9/1973 | English et al. | 62/196 C |
| 3,803,863 | 4/1974 | Jednacz et al. | 62/209 |

*Primary Examiner*—William E. Wayner
*Assistant Examiner*—Robert J. Charvat
*Attorney, Agent, or Firm*—Thomas B. Hunter

[57] ABSTRACT

A control system for air conditioning apparatus particularly of the type utilizing a variable displacement compressor, the capacity of which is modulated in response to a cooling demand control signal. More specifically, the capacity of the compressor is controlled in response to a first signal developed in response to the temperature of air within the space to be controlled and a second signal which is indicative of potential freezing of the evaporator coil. Both of these signals are applied to a control valve actuator which directly varies the capacity of the compressor in a modulated fashion above a predetermined combination of coil and air temperatures and reduces the capacity to zero when below said predetermined combination.

3 Claims, 2 Drawing Figures

Fig. 1.
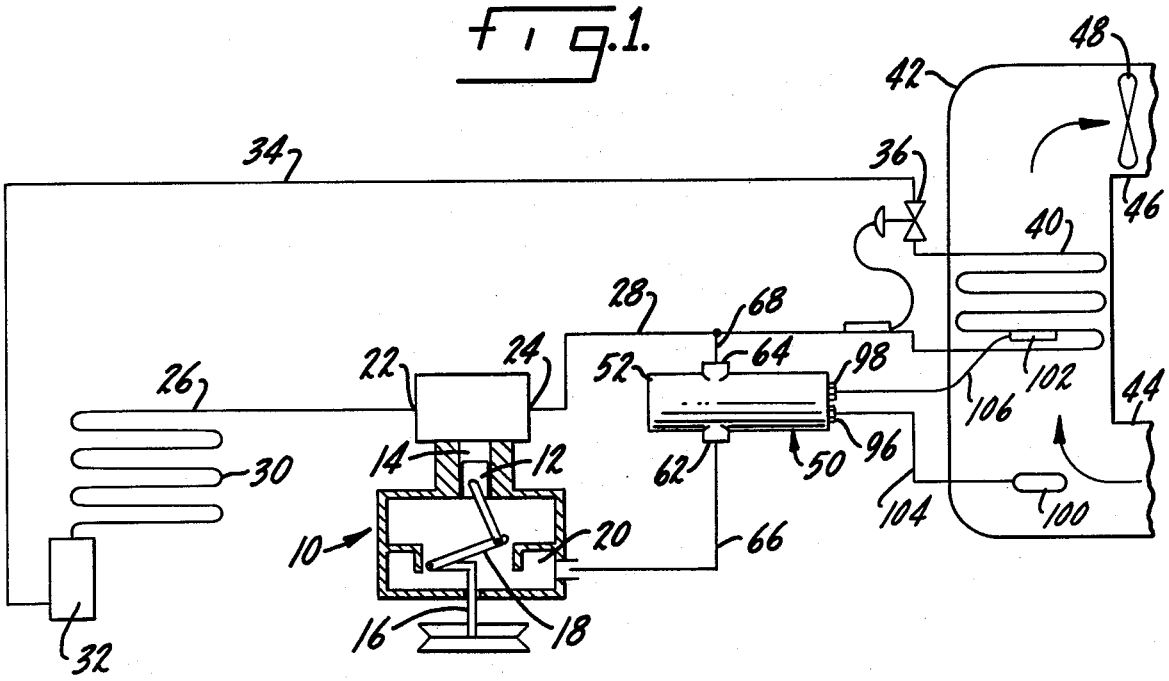
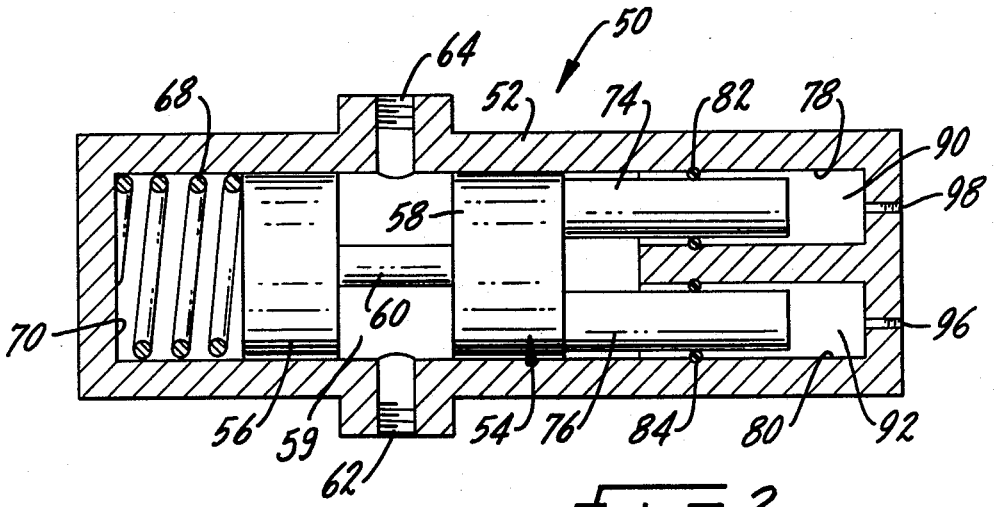
Fig. 2.

AIR CONDITIONER CONTROL SYSTEM

BACKGROUND OF THE INVENTION

1. Field of the Invention

Air conditioning control systems for use with variable capacity compressors including separate input signals: a signal from the temperature of air within the space being conditioned and a signal which is indicative of potential evaporator coil freezing.

2. Description of the Prior Art

Jacobs (U.S. Pat. No. 2,855,761) shows an air conditioning system for an automobile in which the system is controlled by a compartment sensor and switch 47, and an evaporator temperature-calibrated pressure sensor and switch 48.

Gerard (U.S. Pat. No. 3,044,271) and Thompson (U.S. Pat. No. 2,940,278) show air conditioning systems with sensors for both compartment temperature and evaporator coil temperature.

Anderson (U.S. Pat. No. 3,250,084) shows a water cooling system having temperature sensing elements in the input and the output lines. The responses of the element are combined to control the cooling system.

Moy (U.S. Pat. No. 3,636,724) shows an air conditioning system in which a single sensor senses both room temperature and evaporator coil temperature and controls the system in response thereto.

Newton (U.S. Pat. Nos. 2,306,463), Stickel (2,320,055), Noakes et al (3,194,499) and Eschbaugh et al (3,738,573) show air conditioning systems which are controlled by piston valves which are controlled by temperature sensors. Newton and Stickel sense both evaporator temperature and air temperature.

Laporte (U.S. Pat. No. 3,214,930) shows an air conditioning control system in which two bulb-type temperature sensors are disposed at separate locations on the evaporator. The fluid systems of the bulbs are connected together so that the lower of the two bulb pressures controls the switch.

Freeman (U.S. Pat. No. 3,025,881) shows a differential valve of the piston type representative of the art. In this type of valve, the two pressures are additive (or substractive).

Roberts (U.S. Pat. No. 3,959,983) shows a variable displacement compressor of the type which is useful in the air conditioning system described herein. Roberts modulates the capacity of a compressor and maintains a constant suction pressure by using a controlled bleed off of crankcase pressure to the suction line in response to variations in absolute suction pressure.

DESCRIPTION OF THE DRAWINGS

FIG. 1 is a schematic diagram illustrating the principles of the present invention; and FIG. 2 is a cross sectional view of the control valve responsive to input signals from the air temperature and the evaporator coil.

DETAILED DESCRIPTION OF THE INVENTION

While the system described herein may be used in conjunction with several different types of variable compressors, a preferred embodiment of the compressor is one described in U.S. Pat. No. 3,959,983, to R. W. Roberts, issued June 1, 1976. This compressor includes a swashplate to vary the length of stroke of the several pistons in the compression section. When the swashplate is in its vertical position the stroke is virtually zero and no effective work is done on the refrigerant vapor (or other fluid) introduced into the cylinders. If the swashplate is moved to an angular position (with respect to a plane normal to the drive axis), the stroke is increased until the maximum stroke and capacity output are achieved. The swashplate angle is controlled by modulating the pressure within the crankcase. A preferred way of doing this is to selectively bleed fluid in the crankcase to the suction line in response to changes in the demand for compressor capacity. In the Roberts patent, a valve is interposed in a line between the crankcase and the suction line, said valve being moved in response to a control signal proportional to the absolute value of suction pressure.

This system sometimes tends to "hunt", causing rather unstable operation under some conditions. This is believed to be caused by variations in the flow of refrigerant through the expansion valve, in accordance with variations in the load. This causes evaporator pressure to fluctuate; and if the swashplate position is moved in response to changes in suction pressure, the compressor stroke also is varied thus causing the system to "hunt" for an equilibrium position under which all conditions are satisfied.

The control system in the present invention utilizes a control valve responsive to a first signal derived from the temperature of air in the return duct within the space being conditioned. It will be assumed for purposes of this disclosure that the controlled space is the passenger compartment of an automotive vehicle, although it is obvious that the principles could be applied to any air conditioning system.

The other signal is derived from a temperature sensor attached to the evaporator coil. When the temperature of the coil approaches a condition which will result in the freezing of moisture on the coil, this signal will be operative to reduce capacity and avoid this low temperature condition.

As shown in FIG. 1, the compressor 10 includes several piston elements represented by reference numeral 12, corresponding gas working spaces or cylinders 14, a drive means 16 and a variable angle swashplate 18. The crankcase section 20 is essentially fluid tight and is pressurized by "blow-by" vapor from the high pressure side of the compressor by-passing the piston rings. The compressor includes a gas discharge passage 22 and an inlet 24 connecting respectively with the discharge gas line 26 and suction line 28. Discharge gas line 26 is connected in series with condenser 30, receiver 32, hot liquid line 34, thermostatic expansion valve 36 and evaporator coil 40. The evaporator is stationed within an air duct 42 having an air return side 44, an air discharge side 46 and air circulating means 48. The evaporator outlet connects to suction line 28 and completes the circuit back to the compressor inlet 24.

The control device of the present invention comprises a valve 50 having a valve body 52 (see FIG. 2), a spool 54 having a pair of spaced land portions 56, 58 separated by a reduced diameter cylinder 60. The space 59 is between the land portions 56, around the cylinder 60 and within the inner surface of the valve body 52. Valve body includes a pair of spaced ports 62 and 64 respectively connected to the crankcase 20 by way of passage 66 and the suction line 28 by way of passage 68. At one end of spool 54, there is a spring 68 interposed between the end portion 70 of the valve body and the left-hand face of spool 54. At the opposite end are a pair of opposed, cylindrically shaped pistons 74 and 76 respectively received in complementary bores 78 and 80 within the valve body. The pistons are preferably sealed by O-rings 82 and 84 to prevent leakage. The respective right-hand faces of the pistons 74 and 76 form chambers 90 and 92 into which pressurized fluid is introduced. A pair of sensors including fluid bulbs 100, 102 and capillaries 104, 106, of the type familiar to those skilled in the art, communicate with the chambers 90 and 92 through passages 96 and 98 in the end of the valve body. Sensing bulb 100 is located in the path of air return duct 44 and develops a signal in proportinal response to the demand for cooling within the space to be conditioned. Fluid bulb 102 is attached to evaporator coil 40, or otherwise closely associated therewith, to measure the coil temperature. The pressure is translated though capillary 106 to chamber 90 in the control valve. Both fluid bulb and capillary systems are preferably filled with a refrigerant, such as refrigerant R-12.

If the cross sectional areas of pistons 74 and 76 are equal, then the force on the spool opposing spring 68 is directly proportional to the sum of the temperatures sensed by bulbs 100, 102. For example, the valve can be set to close at a passenger compartment air temperature of 70° F. and a coil temperature of 40° F. Thus, if the temperature were any combination of these two values, such as 80° F. car and 30° F. coil, it would also close. Above this combination of temperatures (which equals 110° F.), the system will modulate as appropriate to balance the compressor capacity against the demand for cooling.

OPERATION

If the automobile has been sitting in the sun, it is not unusual for passenger compartment air temperatures to exceed 140° F. This would mean that both the evaporator coil and the air sensing bulb would be producing a signal of a combined temperature of about 280° F. In this case, the spool would be in a wide open position, permitting free flow between ports 62 and 64 thus reducing pressure in crankcase 20 and allowing full capacity of the compressor at start-up conditions. As the temperature within the passenger compartment drops, the demand of the air is sensed by bulb 100 in the return air duct, and the evaporator coil will drop rather quickly. The coil temperature will stabilize in the range from 40°–50° F. until the desired air temperature is reached, at which time the final temperature within the compartment is in the range of 70°–75° F. Then the coil temperature will begin dropping, possibly approaching the freezing point. As the combined temperature of the inlet air and the coil temperature approaches 110° F., by any combination of coil and return air temperatures, the spool will move to the right in response to the pressure in spring 68 thus effectively closing off flow, increasing the pressure in the crankcase 20 and forcing the swashplate to a vertical (virtually zero stroke) position.

While this invention has been described in connection with a certain specific embodiment thereof, it is to be understood that this is by way of illustration and not by way of limitation; and the scope of the appended claims should be construed as broadly as the prior art will permit.

What is claimed is:

1. A control system for a space air conditioning apparatus of the type including a variable capacity compressor, a condenser, an expansion device and an evaporator all connected in closed circuit, series flow relation, and means for circulating air over said evaporator into the space to be conditioned, said system comprising: means for modulating the capacity of said compressor in response to: (1) the temperature of the air in the space to be conditioned and (2) the temperature of said evaporator, said last-named means including a control valve having a valve body and a moveable spool for controlling flow between inlet and outlet ports, a first spool actuator operated in response to the air space temperature and a second spool actuator operated in response to evaporator temperature, and means for coordinating the effect of said first and second spool actuators such that movement of the spool, and concomitant flow control, become an additive function of air and evaporator temperatures.

2. A control system for a space air conditioning apparatus of the type including a variable capacity compressor, a condenser, an expansion device and an evaporator all connected in closed circuit, series flow relation, and means for circulating air over said evaporator into the space to be conditioned, said system comprising: control means for modulating the capacity of said compressor in response to a control signal, said control signal being an additive function of: (1) the temperature of air in said space to be conditioned and (2) the temperature of said evaporator, said control means including a control valve for developing a pneumatic control signal for the modulation of said compressor; a first temperature sensor adapted to sense the temperature of air within the space to be conditioned and a second temperature sensor adapted to sense the temperature of said evaporator; means for combining the effects of variations in the respective temperatures sensed and applying the resultant to said control valve; said control valve including a valve body having fluid inlet and outlet ports, a moveable valve spool having means to control flow from said inlet port to said outlet port; a pair of pistons both being connected to said valve spool and means for applying a first pressure to one of said pistons and a second pressure to the other of said pistons, said first pressure being proportional to the temperature of air in the space to be conditioned and said second pressure being proportional to the temperature of said evaporator.

3. A control system as defined in claim 2 wherein the respective areas of said pistons are equal.

* * * * *